United States Patent [19]

Breed

[11] Patent Number: 4,900,880

[45] Date of Patent: Feb. 13, 1990

[54] GAS DAMPED CRASH SENSOR

[75] Inventor: David S. Breed, Boonton Township, Morris County, N.J.

[73] Assignee: Automotive Technologies International, Inc., Boonton Township, Morris County, N.J.

[21] Appl. No.: 313,630

[22] Filed: Feb. 21, 1989

Related U.S. Application Data

[63] Continuation-in-part of Ser. No. 232,441, Aug. 15, 1988, abandoned.

[51] Int. Cl.[4] ..... H01H 35/14

[52] U.S. Cl. ..... 200/61.45 M; 200/61.53

[58] Field of Search ..... 73/492; 102/262; 280/731, 734, 735; 335/205; 200/61.45 R, 61.45 M, 61.53, 82 E

[56] References Cited

U.S. PATENT DOCUMENTS

| | | | |
|---|---|---|---|
| 2,997,557 | 8/1961 | Gillmor et al. | 200/61.45 M |
| 3,515,827 | 6/1970 | Beeken | 200/82 E X |
| 3,737,599 | 6/1973 | Zuvela | 200/61.53 X |
| 4,329,549 | 5/1982 | Breed | 200/61.53 X |
| 4,484,041 | 11/1984 | Andres | 200/61.45 M |

*Primary Examiner*—J. R. Scott

*Attorney, Agent, or Firm*—Karl F. Milde, Jr.

[57] ABSTRACT

Conventional ball-in-tube, gas-damped, crash sensors utilize a gold plated ball to bridge two contacts. When the ball senses acceleration (deceleration) in the longitudinal direction of a cylinder of sufficient magnitude and duration, it moves to where it bridges the contacts, completing the electrical circuit and initiating deployment of a safety restraint system. The contact duration of this type of sensor is significantly affected by bouncing of the contacts after being hit by the sensing mass and by the accelerations in directions perpendicular to the axis of the tube. This sometimes results in no triggering, or late triggering, of the sensor. A switch activated by magnetic flux is combined with this type of gas-damped sensor to provide a solid and reliable contact duration and ensure the correct functioning of the sensor. The level of biasing force for crash zone crash sensors of this type has been increased to avoid late firing problems on marginal crashes.

13 Claims, 4 Drawing Sheets

GAS DAMPED CRASH SENSOR

CROSS-REFERENCE TO RELATED APPLICATION

This application is a continuation-in-part of the U.S. Pat. application Ser. No. 07/232,441 of David S. Breed filed Aug. 15, 1988 for "IMPROVED GAS DAMPED CRASH SENSOR"., now abandoned

BACKGROUND OF THE INVENTION

Gas damped crash sensors have become widely adopted by many of the world's automotible manufacturers to sense that a crash is in progress and to initiate the inflation of an air bag or tensioning of seat belts. Sensors constructed from a ball and a tube are disclosed in U.S. Pat. Nos. 3,974,350, 4,198,864; 4,284,863; 4,329,549 and 4,573,706 to D. S. Breed. A sensor constructed in the form of a rod with an attached coaxial disk, both arranged to move within a cylinder, is disclosed in the U.S. Pat. No. 4,536,629 to R. W. Diller.

Recently, it has been found that although the sensors disclosed in the Breed patents generally perform well during high speed crashes, their performance deteriorates significantly in marginal crashes especially when strong cross axis accelerations are present. One automobile manufacturer requires that the air bag not be deployed on crashes into barriers at 9 mph and always be deployed for crashes into barriers at 12 mph or above. When crash sensors are designed to meet this criterion, they perform well on laboratory shock test equipment. However, when placed on a vehicle and crash tested into a barrier at 12 mph the sensor frequently either does not trigger at all or triggers late. In the first case the occupant does not receive the protection of the air bag or belt tensioning device, and in the second case he/she is at risk of being injured by the deployment of the air bag.

It has been hypothesized and shown theoretically that there are some conditions where the sensing ball does not merely roll down one side of the tube but in fact undergoes a rather complicated whirling or orbiting motion. When this happens, a significant amount of energy is dissipated through sliding friction between the ball and the tube. This phenomenon has the effect of substantially delaying the motion of the ball and, on a marginal crash it can lead to a no-trigger or a late trigger condition.

This type of motion is caused by accelerations which are perpendicular to the longitudinal axis of the sensor tube. In the typical mounting arrangement, the sensor tube axis points toward the front of the vehicle and it is the accelerations in the vertical and lateral directions that can cause the whirling motion described above.

Cross axis vibrations have other undesirable effects, particularly on the electrical contact design currently used in gas damped ball-in-tube sensors. In particular, since the standard contact is a cantilevered beam, vibrations of the sensor can cause the contacts to vibrate resulting in several intermittent "tic" closures before solid contact is achieved. Similarly, when the contacts are first impacted by the sensing mass, (i.e. the ball) they frequently bounce one or more times. In one particular crash at 14 mph in which significant cross axis accelerations were present, the ball momentarily bridged the contacts causing a "tic" closure of insufficient duration to reliably trigger the air bag. Although this closure was on time, the air bag did not deploy until much later when a more solid contact closure occurred.

The ball-in-tube sensor currently in widespread use has a magnetic bias. Both ceramic and Alnico magnets are used depending upon the amount of variation in bias force caused by temperature that can be tolerated. Sensors used in the crush zone of the vehicle, and safing or arming sensors used both in the crush zone and out of the crush zone, can have ceramic magnets since they can tolerate a wide variation in bias force. Alnico magnets are used for the higher biased non-crush zone discriminating sensors where little variation in the bias can be tolerated. If a spring bias is employed in place of the magnetic bias as shown in the U.S. Pat. No. 4,580,810 to T. Thuen, the variation of the bias force with temperature can be practically eliminated. The use of a spring bias can also have the effect of reducing contact bounce and minimizing the effect of cross axis vibration on the contacts.

In the conventional ball-in-tube sensor, two cantilevered contacts are bridged by a gold plated ball. The gold plating is required to minimize the contact resistance between the ball and the contacts which are also gold plated. Gold is soft and easily damaged and the precise plating thickness and uniformity is difficult to control with the result that the dimensional tolerances of the ball can vary. This, in turn, affects the overall accuracy of the sensor. If the gold is eliminated from the ball, the cost of the ball may be substantially reduced and the accuracy of the sensor may be improved.

The thickness of the gold plating on the sensing ball is important from a corrosion viewpoint. A very thin coating of gold is all that is required to reduce the contact resistance. A thin coating, however, is porous and since gold has a different electromotive potential than the stainless steel ball, galvanic corrosion can take place if moisture is present in the sensor. Thus, a thick plating is preferred but this further increases the cost and reduces the dimensional accuracy of the ball. If the sensing mass, instead of bridging the contacts, is arranged to push one contact into another, the gold on the ball can be eliminated.

The U.S. Pat. No. 4,536,629 to R. W. Diller discloses a rod-in-cylinder gas damped crash sensor in which a contact spring is employed to provide a spring bias to the sensing mass. The U.S. Pat. No. 4,116,132 to Bell also uses a spring for bias. These sensors are also susceptable to contact bounce during operation.

The U.S. Pat. No. 4,329,549 to D. S. Breed discloses a biasing force of two to three G's applied to the sensing mass in a gas damped crash sensor. It indicates further that a biasing force of five G's need not be exceeded for such a crash sensor. However, a thorough study of vehicle crash libraries, has revealed that, when a crash sensor of this type is placed in the crush zone of a vehicle and is not located in the crush zone in certain marginal crashes, it will trigger too late and thus cause injuries to out-of-position occupants. For these marginal crashes, an occupant without deployment of an air bag will probably not be injured as seriously as by a late deploying bag. It is therefore desirable to make a crush zone sensor which does not trigger at all in these cases.

SUMMARY OF THE INVENTION

A crash sensor according to the invention is adapted for installation on an automotive vehicle equipped with a passenger protective device such as an inflatable air bag or seat belt tensioner. When such vehicle is subjected to deceleration of the kind accompanying a crash, the air bag is inflated to provide a protective cushion for the occupant or the seat belt is pulled back against the occupant holding him in a safe position.

A sensor constructed according to the invention comprises a housing adapted to be mounted on the vehicle in a position to sense and respond to deceleration pulses. Within the housing is a body containing a tubular passage in which is mounted a movable deceleration sensing mass. The mass is movable in response to a deceleration pulse above a threshold value from an initial position along a path leading to a normally open switch that is connected via suitable wiring to the operating mechanism of an inflatable air bag or seat belt tensioner.

A biasing spring or magnet acts on the deceleration sensing mass to bias the latter to its initial position under a preselected force which must be exceeded before the sensing mass may move from its initial position. When the sensing mass is subjected to a decleration creating an inertial force greater than the preselected biasing force, it moves from its initial position toward its air bag or seat belt tensioner operating position. Movement of the sensing mass is fluid damped, thereby delaying the motion of the sensing mass from its initial position to its operating position, during which time the deceleration must continue to exceed the bias force. Fluid damping is controlled by the clearance between the sensing mass, which in a preferred embodiment is a ball, and the tubular passage.

According to one feature of the present invention the magnet which is used as the biasing means for the sensing mass is brought into service to prevent contact bounce when the sensor is activated. In particular, the electrical contacts are constructed of magnetically permeable material and means are provided in the sensor to concentrate the magetic flux originating from the magnet through the electrical contacts when the sensing mass is moved to the contact-actuating location. The electrical contacts are thereby mutually attracted to each other and will remain closed once they come in contact.

According to another feature of the invention, it has been discovered that increasing the biasing force from 2 or 3 G's of the conventional gas damped sensors to approximately 6 G's can solve the late-firing problems present in the conventional sensors, without affecting the sensitivity of the sensor for other crashes. Preferably, the level of the biasing force for crush zone crash sensors is increased to greater than 5 G's and, more particularly, to the range of within 5–10 G's.

It is a principal object of the present invention to provide a contact design for a vehicle crash sensor which eliminates contact bounce.

It is another object of this invention to utilize the magnetic field which is present in a magnetically biased crash sensor to cause one contact to be held against a second contact when the sensor triggers.

It is another object of this invention to utilize one contact as a biasing force against the ball which is pushed into a second, more rigid contact in a vehicle crash sensor, thus eliminating both contact bounce and the magnet.

It is a further object of this invention to devise a smaller, simpler and less expensive vehicle crash sensor.

It is an additional object of this invention to eliminate the need for gold pating on the sensing mass of a vehicle crash sensor.

It is still another object of this invention to provide a level of higher biasing force than is previously known in damped crush zone sensors to eliminate the late firing problems of such crash sensors on marginal crashes.

Other objects and advantages of the present invention will become apparent from the following description of the preferred embodiments taken in conjunction with the accompanying drawings.

DESCRIPTION OF THE PREFERRED EMBODIMENTS

Figure 1:
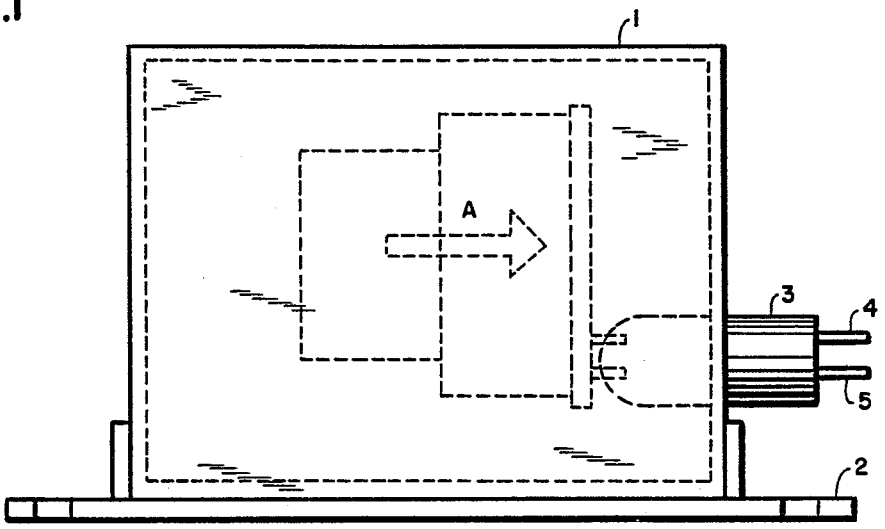
FIG. 1 is an elevational view of sensing apparatus in condition for installation on an automotive vehicle.

Apparatus constructed in accordance with the invention as illustrated generally in FIG. 1, is adapted for use in conjunction with an automotive vehicle or truck (not shown) and is accommodated within a closed, metallic housing 1 having a mounting bracket 2 by means of which the housing can be secured to the vehicle. Extending from and secured to the housing is one end of an insulating sheath 3 within which are electrical conductors 4 and 5 that form part of an electrical circuit as disclosed in the aforementioned U.S. Pat. No. 4,329,549 to D. S. Breed. The interior configuration of the housing 1 is complementary to the sensor apparatus so as to snugly retain the latter within the housing. Frequently the housing is filled with epoxy or a sand and epoxy mixture to further retain and seal the sensor within the housing. In other cases, the housing is hermetically sealed.

Figure 2:
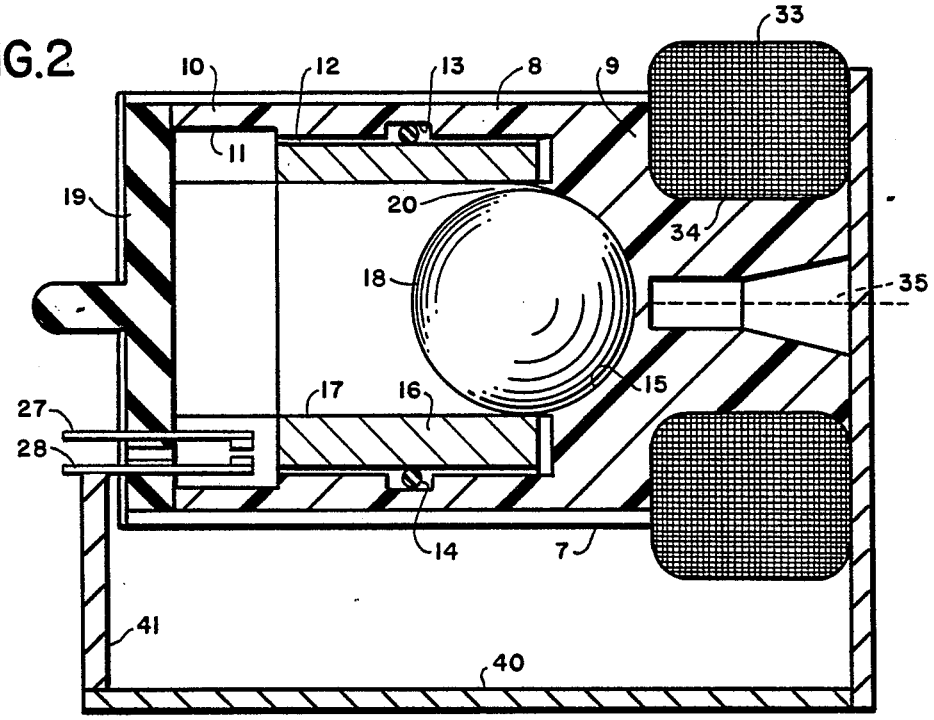
FIG. 2 is a transverse sectional view of sensing apparatus incorporating magnetic latching of the contacts, removed from its housing and illustrating the parts in positions they occupy when the apparatus is inactive.
Figure 3:
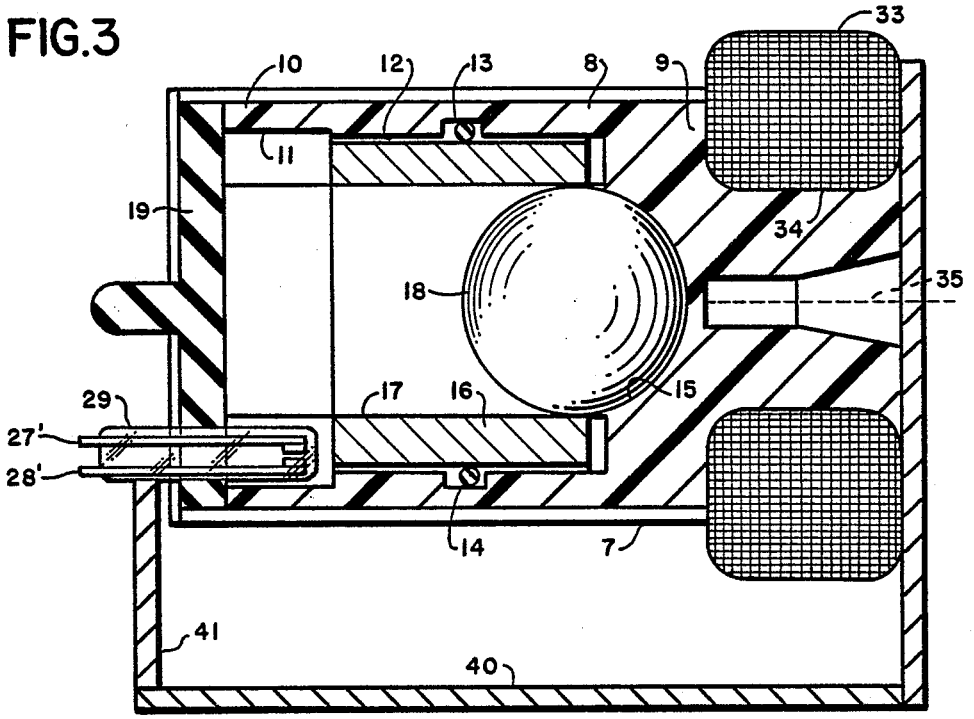
FIG. 3 represents an alternate configuration of the contacts in the apparatus of FIG. 2, which contacts are enclosed in glass.

The sensor apparatus is designated generally by reference number 6 in FIG. 2, and comprises a body 7 formed of suitable plastic material and having a cylinder 8 closed at one end by a wall 9. At the other end of the body is an enlarged cylinder skirt 10 defining a cylindrical chamber 11. Communicating with the chamber 11 is a bore 12. The inner surface of the end wall 9 is provided with a semi-spherical, concave seat 15. Fitted into the bore 12 is a metallic sleeve 16 having a smooth inner surface forming a tubular passage 17 and on the outer diameter, midway along the sleeve, is a groove 13 in which is accommodated a rubbery sealing and vibration isolating ring 14 which also holds the sleeve in place.

Accommodated within the passage 17 is a spherical, magnetically permeable, electrically conductive sensing mass 18, the radius of which corresponds substantially to that of the seat 15 and the diameter of which is slightly less than that of the tubular passage 17. Between the ball 18 and the tubular passage 17 is a tight clearance 20. When the ball moves along the passage, a pressure difference is created between two sides of the ball due to the resistance experienced by the gas in passing through the tight clearance. This gas flow is a mixture of both viscous and inertial flow, and it is mainly controlled by the clearance of the sensor. The pressure difference thus applies a resistant damping force on the ball.

Fixed in the cylinder 11 is a cylindrical plug 19 formed of electrically insulating material, the plug being fixed in the chamber in any suitable manner, such as by cement, by ultrasonic welding, by crimping the rim of the skirt, or a combination thereof.

Means are provided for applying a magnetic biasing force on the sensing mass 18, such means comprise an annular magnet 32 having a hole 34 therethrough in which is received a mounting ferrule 35 forming a part of the body 7 and projecting beyond the wall 9. The magnet 33 may be maintained snugly in abutting relation with the body wall 9 by outwardly swaging or expanding the free end of ferrule 35.

Figure 7:
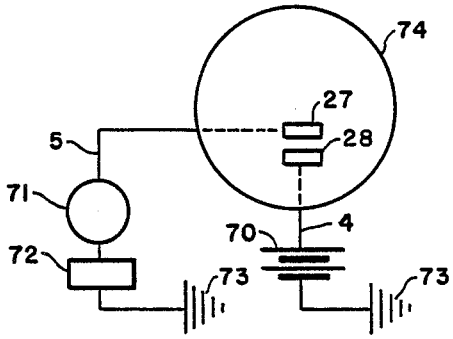
FIG. 7 is a sectional view taken along line 7—7 of FIG. 2 and also including a simplified schematic wiring diagram.

To condition the apparatus for operation, the sensor mechanism is fitted into the housing 1 shown in FIG. 1 and the latter is fixed to a vehicle with the longitudinal axis of the passage 17 parallel or at a predetermined angle to the longitudinal axis of the vehicle. FIG. 7 is a schematic diagram of the circuitry connected to the sensor. The sensor 74 in this case is arranged in the circuit with the conductors 4 and 5 connected to the vehicle battery 70, the restraint operating instrumentality 71, the restraint apparatus 72 and the circuit grounding 73. The contacts 27 and 28 inside the sensor 74 close the circuit when the sensor is triggered.

The magnet will exert a magnetically attractive force on the sensing mass 18 so as to normally retain the latter in an initial, inactive position on the seat 15 at the closed end of the passage 17.

If the vehicle on which the sensor is mounted is traveling in the direction of the arrow A (FIG. 1), the sensing mass 18 will remain in its position until such time as the vehicle experiences a deceleration pulse greater than the biasing force exerted on the mass 18 by the magnet 33. If such deceleration pulse is of sufficient magnitude and duration, the sensing mass 18 will move from the position shown in FIG. 2 to an operating position, shown in FIG. 4, in which the mass causes contacts 27 and 28 to contact and complete the electrical circuit, shown in FIG. 7, from the energy source (battery) 70 to the operating instrumentality 71 so as to activate the restraint device 72.

Contacts 27 and 28 are made from a magnetically permeable material. In the presence of a magnetic field the contacts 27 and 28 will therefore bend toward each other closing the circuit in the manner of conventional reed switches. When the ball 18 moves to a position adjacent to contacts 27 and 28, the magnetic flux lines travel between the ball 18 and the left end 41 of the magnetic circuit element 40. This concentration of flux lines caused by the ball designated by lines 42 in FIG. 4 causes contacts 27 and 28 to bend towards each other making contact.

When the ball 18 returns to the seat 15 at the end of a crash, the concentration of flux lines is removed and contacts 27 and 28 spread apart.

This arrangement eliminates contact bounce since once the two contacts make contact, the magnetic force holding them together exceeds the magnetic force needed to cause initial contact. Thus an hysteresis effect exists.

Figure 4:
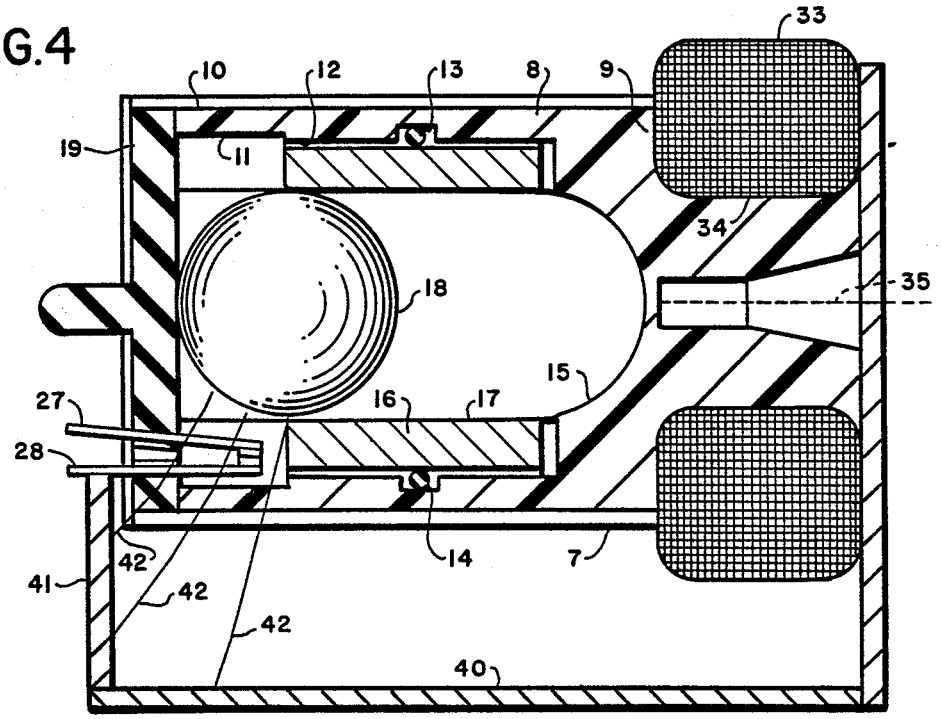
FIG. 4 is a view as in FIG. 2, but illustrating the parts of the sensing apparatus in their active position.

Although contacts 27 and 28 shown in FIG. 2 are illustrated as being mounted in the sensor header, an alternative approach would be to make use of a standard reed switch 29 enclosed in glass as shown in FIG. 4. Here, contacts 27' and 28' perform in the same manner as contacts 27 and 28 in FIG. 2.

Figure 5:
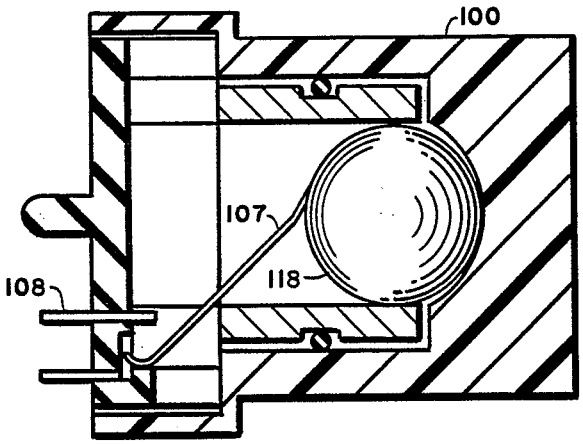
FIG. 5 is a transverse sectional view of sensing apparatus removed from its housing and incorporating one contact to provide the bias force on the ball and a second more rigid contact.
Figure 6:
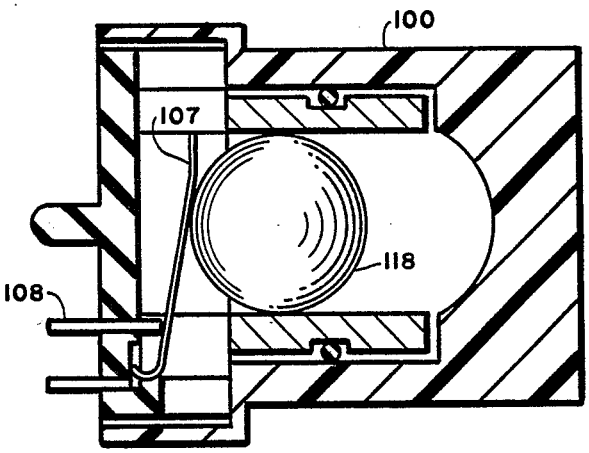
FIG. 6 is a view as in FIG. 5, but illustrating the parts of the sensing apparatus in their active position.

An alternate preferred embodiment of the sensor is shown in FIG. 5 generally as 100. A contact spring 107 presses on the ball providing the necessary bias. Two terminals 108 and 109 are extended outside of the sensor 100 to be connected to the circuitry of the vehicle. The contact spring 107 is connected to one of the terminals 109. During a crash, the ball 118 moves toward the front of the vehicle to the left in FIG. 5; however, its motion is opposed by the contact biasing force and a difference in pressure across the ball 118. This pressure differential is gradually relieved by the flow of the gas through the clearance 120 between the ball 118 and the cylinder 117. The tight clearance 120 provides a damping effect on the motion of the sensing mass. The force exerted by the contact spring 107 against the ball at all times exceeds the inertial forces caused by vibrations acting on the contact. Thus, the contact 107 always physically touches the ball 118. If the crash is of sufficient severity, ball 118 moves to the left sufficiently to bend contact spring 107 to touch contact 108, completing the electrical connection and initiating the safety apparatus as shown in FIG. 6. Since the contact 108 is rigid and the contact 107 is pressed against the ball, neither contact will vibrate and thus solid contact closure results.

In both embodiments shown herein, the sensing mass is not part of the electrical circuit. Therefore, the need for gold on the sensing mass has been eliminated resulting in a less expensive and more accurate sensor. In the embodiment shown in FIGS. 5 and 6, the need for the magnet is also eliminated resulting in a much smaller and simpler sensor. Also, since only a single contact is made, instead of the bridging of two contacts as in the conventional ball-in-tube sensor, the size of the sensing mass can be reduced, while maintaining the same contact pressure and further reducing the size and cost of the sensor.

As will be evident to those skilled in the art, other types of sensors could make use of the present invention for improved contact closures. placed in the crush zone of a vehicle. The crush zone is that portion of the vehicle which undergoes significant plastic deformation during an accident and where both longitudinal and cross axis vibrations are of signficant magnitude and can seriously effect the sensor behavior in marginal crashes.

In a paper "Trends in Sensing Frontal Impacts" by D. S. Breed and V. Castelli, to be presented on Feb. 27, 1989 at *SAE* 1989 *Symposium*, the importance of placing the crush zone sensor in the crush zone is discussed and illustrated. As soon as the sensor is moved back to a location that might reasonably represent the location of a front center crush zone sensor relative to an angular impact, the sensor begins to fire late on a significant number of pulses. These are mostly marginal pulses in which it would be better for the sensor not to fire at all than to fire late. Based on the study of a car crash library, it has been discovered that a standard crush zone sensor with a bias of 2–3 G's triggers late for a number of pulses between 12 and 16 MPH. A significant improvement can be made in a viscous damped sensor by increasing the bias to the range of within 5–10 G's to reduce the incidence of sensor triggering on long duration pulses which are indicative of the sensor not being in the crush zone.

Figure 8:
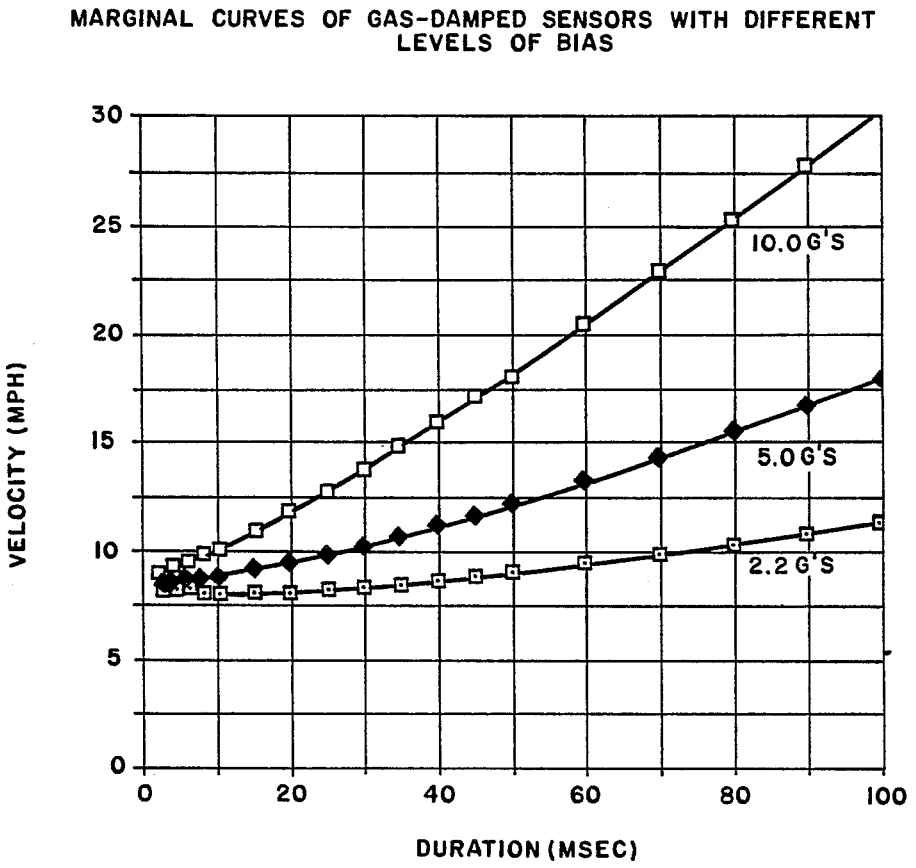
FIG. 8 is a graph showing marginal curves of gas-damped crash sensors with different levels of bias.

FIG. 8 shows the triggering curves for a gas-damped, crash sensor arranged in the crush zone of a vehicle. In the region below each curve, the sensor does not fire; crash parameters located above each curve cause firing of the sensor. If a sensor is allowed to fire later than about 30 milliseconds after the beginning of a crash pulse the resulting deployment of the occupant restraint system may cause harm to the occupant.

As may be seen, a gas-damped crash sensor with a 2.2 G bias can easily fire substantially later than 30 ms provided that a relatively mild crash pulse continues for this period. If the bias is increased to above 5 G's, as indicated by a second curve in FIG. 8, the possibility of late firing is eliminated for all crashes except those which continue to be severe or for which the crash pulse continues due to a secondary collision. Bias levels above about 10 G's do not permit effective crash sensing even in the low (1–30 ms) region as indicated by the third curve in FIG. 8. However, the paramaters of a sensor, such as the clearance between the sensing mass and the cylinder or the travel of the sensing mass, can be adjusted to obtain the required sensitivity when the bias level is changed. Therefore, the sensor performance is not restricted to the curves shown in FIG. 8 by the increase of the bias level.

There has thus been shown and described an improved gas damped crash sensor which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the following claims.

What is claimed is:

1. A crash sensor comprising:
(a) a tubular passage;
(b) a magnetically permeable sensing mass, arranged to move in said passage between a first location and a second location;
(c) a magnet for biasing said sensing mass toward said first location in said passage;
(d) first and second electrical contacts arranged to come in contact with each other when said sensing mass is moved to said second location, both said first and said second contacts being constructed of magnetically permeable material;
(e) means for concentrating magnetic flux from said magnet through said first and second contacts in response to the presence of said sensing mass at said second lcoation, such that said contacts are mutually attracted to each other and tend to remain in contact once closed as long as said flux is present.

2. The crash sensor in accordance with claim 1, wherein a tight clearance is provided between said sensing mass and said tubular passage, and wherein said passage is substantially closed at least at one end to the flow of fluid, thereby requiring fluid in said passage to pass through said tight clearance when said mass moves from said first location to said second location.

3. The crash sensor in accordance with claim 1, wherein said first and second contacts are enclosed in glass.

4. The crash sensor in accordance with claim 1, wherein said flux concentration means includes a magnetically permeable member to channel magnetic flux from said sensing mass at said second location in said passage to said first and second contacts.

5. The crash sensor in accordance with claim 1, wherein said sensing mass is a ball.

6. The crash sensor in accordance with claim 1, wherein said first and second contacts are normally open and in close proximity to each other, and wherein said flux concentrating means operates to close said first and second contacts when said sensing mass is moved to said second location.

7. A crash sensor adapted for locations in the crush zone of a motor vehicle for detecting motor vehicle crashes comprising:
(a) a tubular passage;
(b) a sensing mass arranged to move in said passage between a first location and a second location;
(c) means to dampen the motion of said sensing mass in said passage;
(d) means for biasing said sensing mass toward said first location in said passage with an average force of more than 5 G's; and
(e) means for closing an electrical circuit when said sensing mass moves to said second location in said passage.

8. The crash sensor in accordance with claim 7, wherein said biasing means provides an average biasing force magnitude in the range of within 5 to 10 G's within the moving range of said sensing mass in said passage.

9. A sensor for detecting a motor vehicle crash comprising:
(a) a tubular passage;
(b) a sensing mass arranged to move in said passage in response to a vehicle crash, there being a tight clearance between said sensing mass and said passage such that the movement of said sensing mass with respect to said passage is damped by gas flow;
(c) a flexible first electrical contact;
(d) a second more rigid electrical contact in proximity to said first contact;
(e) means responsive to the movement of said sensing mass with respect to said passage for displacing said first contact toward said second contact causing said first and second contact to close an electrical circuit during a crash;
(f) means for biasing said sensing mass so as to maintain said first and second contacts in open relationship in the absence of a vehicle crash.

10. The crash sensor in accordance with claim 9, wherein said first contact is normally in contact with said sensing mass and said biasing means includes said first contact.

11. The crash sensor in accordance with claim 9, wherein said sensing mass is a ball.

12. The crash sensor in accordance with claim 9, wherein the movement of said sensing mass with respect to said passage is damped by the gas flow through said tight clearance between said sensing mass and said passage.

13. The crash sensor in accordance with claim 9, wherein said means for biasing said sensing mass applies an average force in the range of within 5 to 10 G's when said sensing mass is in any position within said passage.

* * * * *